US008211358B2

(12) United States Patent
Jansson et al.

(10) Patent No.: US 8,211,358 B2
(45) Date of Patent: Jul. 3, 2012

(54) CEMENTED CARBIDE AND METHOD OF MAKING THE SAME

(75) Inventors: Bo Jansson, Ramsberg (SE); Susanne Norgren, Huddinge (SE)

(73) Assignee: Sandvik Intellectual Property AB, Sandviken (SE)

( * ) Notice: Subject to any disclaimer, the term of this patent is extended or adjusted under 35 U.S.C. 154(b) by 650 days.

(21) Appl. No.: 11/704,959

(22) Filed: Feb. 12, 2007

(65) Prior Publication Data

US 2007/0196694 A1 Aug. 23, 2007

Related U.S. Application Data

(62) Division of application No. 10/961,192, filed on Oct. 12, 2004, now Pat. No. 7,220,480.

(30) Foreign Application Priority Data

Oct. 23, 2003 (SE) ..... 0302783

(51) Int. Cl.
*C22C 1/05* (2006.01)

(52) U.S. Cl. ..... 419/10; 419/14; 419/15; 419/18; 419/30; 419/38; 419/49; 427/255.11

(58) Field of Classification Search ..... 419/10, 419/14, 15, 18, 30, 38, 49; 427/255, 255.1
See application file for complete search history.

(56) References Cited

U.S. PATENT DOCUMENTS

| | | | | |
|---|---|---|---|---|
| 4,698,266 | A | 10/1987 | Buljan et al. | |
| 4,843,039 | A | 6/1989 | Akesson et al. | |
| 5,462,901 | A | 10/1995 | Egami et al. | |
| 5,580,666 | A * | 12/1996 | Dubensky et al. | 428/552 |
| 5,918,102 | A * | 6/1999 | Friederichs | 419/15 |
| 6,071,469 | A | 6/2000 | Rohlin et al. | |
| 6,228,139 | B1 | 5/2001 | Oskarsson | |
| 6,267,797 | B1 | 7/2001 | Ostlund et al. | |
| 6,685,880 | B2 | 2/2004 | Engstrom et al. | |
| 6,761,750 | B2 * | 7/2004 | Zackrisson et al. | 75/240 |
| 2003/0211366 | A1 | 11/2003 | Ruppi | |

FOREIGN PATENT DOCUMENTS

| | | | |
|---|---|---|---|
| EP | 0 440157 | * | 1/1990 |
| EP | 1 043 416 | A2 | 10/2000 |
| EP | 1 314 790 | A2 | 5/2003 |

(Continued)

OTHER PUBLICATIONS

C. Chatfield, "The gamma/WC solubility boundary in the quaternary TiC-NbC-TaC-WC system at 1723 K", *J. Mat. Sci.*, vol. 21, No. 2, 1986, pp. 577-582.

(Continued)

*Primary Examiner* — Archene Turner
(74) *Attorney, Agent, or Firm* — Morgan, Lewis & Bockius LLP

(57) ABSTRACT

A cemented carbide including WC, a binder phase based on Co, Ni or Fe, and gamma phase, in which said gamma phase has an average grain size <1 μm. A method of making the cemented carbide is provided in which the powders forming gamma phase are added as mixed cubic carbides of one or more of Ti, Ta, Nb, Zr, Hf and V, and a ratio, $f_{WC}$, between an amount of WC (in mol fraction of WC) and an equilibrium gamma phase WC content at a sintering temperature (in mol fraction WC) is given by $f_{WC}=x_{WC}/xe_{WC}$, wherein $f_{WC}$ is 0.6 to 1.0.

11 Claims, 3 Drawing Sheets

FOREIGN PATENT DOCUMENTS

| | | | |
|---|---|---|---|
| EP | 1 348 779 | A1 | 10/2003 |
| JP | 56-112437 | | 9/1981 |
| JP | 61-147841 | | 7/1986 |
| JP | 63-297537 | | 12/1988 |
| JP | 02-073946 | | 3/1990 |
| JP | 2-228474 | | 9/1990 |
| JP | 3-146668 | | 6/1991 |
| JP | 3-146677 | | 6/1991 |
| JP | 03-226576 | | 10/1991 |
| JP | 11-61315 | | 2/1999 |
| JP | 2000-334608 | | 12/2000 |
| JP | 2002-038205 | | 2/2002 |
| JP | 2003-311510 | | 11/2003 |
| JP | 2004-232001 | | 8/2004 |
| WO | 96/22399 | | 7/1996 |
| WO | 03/010350 | A1 | 2/2003 |

OTHER PUBLICATIONS

Notice of Reasons of Rejection dated Mar. 16, 2010, issued in Japanese patent application No. 2006-115790.

Japanese Office Action mailed Mar. 16, 2010, in JP 2004-309742 (English translation).

Notice of Reasons of Rejection with English Language Translation dated Aug. 5, 2011, issued in Korean patent application No. 2004-0084494.

* cited by examiner

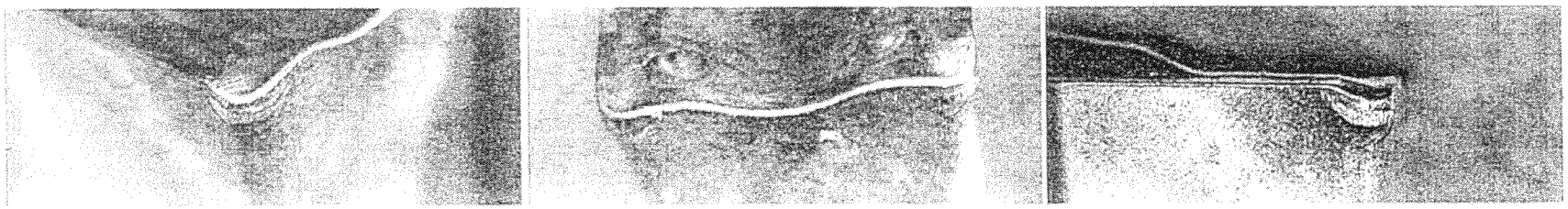
Fig. 3a, b, c
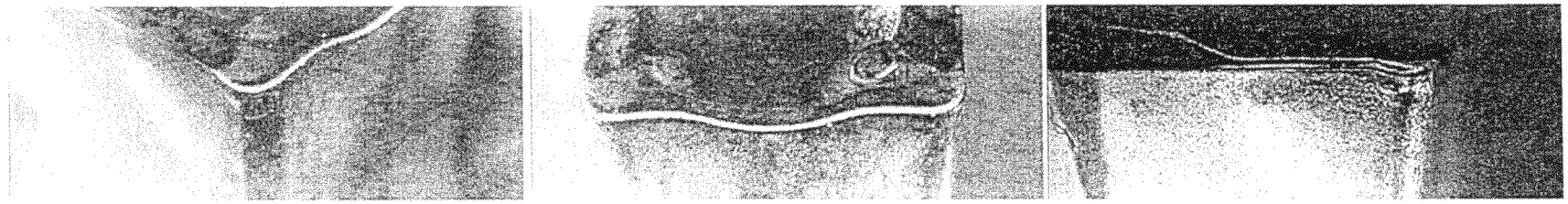
Fig. 4a, b, c

CEMENTED CARBIDE AND METHOD OF MAKING THE SAME

RELATED APPLICATION DATA

This application is a divisional application of U.S. application Ser. No. 10/961,192, filed Oct. 12, 2004 now U.S. Pat. No. 7,220,480, which is based on and claims the benefit of priority under 35 U.S.C. §119 to Swedish Application No. 0302783-6, filed in Sweden on Oct. 23, 2003, the entire contents of each of these prior applications are incorporated herein by reference.

FIELD OF THE DISCLOSURE

The present disclosure relates to a cemented carbide comprising WC, particularly with submicron grain size, which is bound by means of a second phase of a metallic binder based on Co, Ni or Fe and in addition gamma phase (a cubic carbide phase) of submicron size and a method of making the same.

STATE OF THE ART

In the discussion of the state of the art that follows, reference is made to certain structures and/or methods. However, the following references should not be construed as an admission that these structures and/or methods constitute prior art. Applicant expressly reserves the right to demonstrate that such structures and/or methods do not qualify as prior art against the present invention.

Cemented carbide grades for metal cutting applications generally contain WC with an average grain size in the range 1-5 μm, gamma phase (a solid solution of at least one of TiC, NbC, TaC ZrC, HfC and VC and substantial amounts of dissolved WC) and 5-15 wt-% binder phase, generally Co. Their properties are optimised by varying the WC grain size, volume fraction of the binder phase and/or the gamma phase, the composition of the gamma phase and by optimising the carbon content.

Cemented carbides with submicron WC grain size structure are today used to a great extent for machining of steels, stainless steels and heat resistant alloys in applications with high demands on both toughness and wear resistance. Another important application is in microdrills for the machining of printed circuit board, so called PCB-drills.

Submicron grades contain grain growth inhibitors. Common grain growth inhibitors include vanadium, chromium, tantalum, niobium and/or titanium or compounds involving these. When added, generally as carbides, grain growth inhibitors limit grain growth during sintering, but also have undesirable side effects, affecting the toughness behaviour in an unfavourable direction. Additions of vanadium or chromium are particularly detrimental and have to be kept on a very low level in order to limit their negative influence on the sintering behaviour. Both vanadium and chromium reduce the sintering activity often resulting in an uneven binder phase distribution and toughness, reducing defects in the sintered structure. Large additions are also known to result in precipitation of embrittling phases.

In cemented carbides for metal cutting purposes, the quality of a cemented carbide grade is dictated quite substantially by its high-temperature properties. The hardness of the cemented carbides is reduced in some cases dramatically as temperature rises. This applies particularly to submicron grades, which generally have relatively high cobalt content.

A common way of increasing the hot hardness and also the chemical wear resistance of cemented carbides is to add cubic carbides forming a suitable amount of gamma phase. However, when adding submicron cubic carbides, such as NbC, TaC, TiC, ZrC and HfC or mixed carbides of the same elements, to a submicron cemented carbide, the gamma phase formed during sintering will have a grain size of the order of 2-4 μm. Thus, the grain size is not submicron and the beneficial effects of the submicron WC grain size will, to some extent, be lost. The gamma phase formed during sintering is growing by a dissolution and precipitation process and will dissolve substantial amounts of tungsten.

The above also relates to cemented carbide of more coarse grains size, but in this the effect is less pronounced.

The amount of WC dissolved in the gamma phase in equilibrium with the hexagonal WC at a temperature of 1450° C., a typical sintering temperature, for Ti, Nb and Ta based gamma phase has been experimentally determined by Chatfield ("The gamma/WC solubility boundary in the quaternary TiC-NbC-TaC-WC system at 1723K", J. Mat. Sci., Vol 21 (1986), No 2, pp 577-582). The equilibrium solubility of WC in the gamma phase expressed as mol fraction, $xe_{WC}$, can with a good accuracy be expressed by the following equation:

$$xe_{WC}=(0.383*x_{TiC}+0.117*x_{NbC}+0.136*x_{TaC})/(x_{TiC}+x_{NbC}+x_{TaC}) \quad \text{(Eq. 1)}$$

The amount of WC in the prealloyed cubic carbide raw material, $x_{WC}$, can be related to the equilibrium amount by the equation:

$$x_{WC}=f_{WC}*xe_{WC} \quad \text{(Eq. 2)}$$

The factor $f_{WC}$ is the ratio between the WC content in the cubic carbide raw material and the WC solubility in the gamma phase and $f_{WC}$ is about 1 or less to minimize and/or to avoid decomposition of the gamma phase at the sintering temperature. A person skilled in the art can derive equations similar to equation (1) from experimental data available in the literature on the WC solubility at typical sintering temperatures for other mixed cubic carbides based on different combinations of TiC, TaC, NbC, ZrC, HfC and VC.

SUMMARY

It is an object of the present invention to provide a cemented carbide preferably with submicron grain size containing submicron gamma phase.

It is a further object of the present invention to provide a method of making cemented carbide, preferably with submicron grain size, containing, preferably, submicron, gamma phase.

It has now surprisingly been found that alloying a submicron cubic carbide raw material with WC results in a submicron gamma phase in the sintered material.

An exemplary embodiment of a cemented carbide comprises WC; a binder phase based on Co, Ni or Fe, and a gamma phase, wherein said gamma phase has an average grain size <1 μm.

An exemplary embodiment cemented carbide comprises WC having an average grain size less than one micro, a binder phase based on Co, Ni or Fe, and a gamma phase having an average grain size less than one micron, wherein a binder phase content is 3 to 15 wt.-% and an amount of gamma phase is 3 to 25 vol-%.

An exemplary method of making a cemented carbide, the cemented carbide including a binder phase based on Co, Ni or Fe, and a gamma phase, comprises wet milling powders forming hard constituents and binder phase, drying the wet milled powders, pressing and sintering the dried milled powders to form a body having a desired shape and a desired dimension, wherein powders forming gamma phase are added as a cubic mixed carbide (Me, W)C alloyed with an amount of WC, the amount of WC given by mol fraction of WC, $x_{WC}$, wherein Me is one or more of Ti, Ta, Nb, Zr, Hf and V, wherein a ratio, $f_{WC}$, between $x_{WC}$ and an equilibrium gamma phase WC content at a sintering temperature expressed as mol fraction WC, $xe_{WC}$, is given by $f_{WC}=x_{WC}/xe_{WC}$, wherein $f_{WC}$ is 0.6 to 1.0.

BRIEF DESCRIPTION OF THE DRAWING FIGURES

In FIG. 1, A is WC, B is gamma phase, and C is binder phase.

In FIG. 2, A is WC, B is gamma phase, and C is binder phase.

FIGS. 3*a, b* and *c* and FIGS. 4*a, b* and *c* show, in about 10× magnification, the wear pattern of a reference insert and that of an insert made according to the present disclosure, respectively.

DETAILED DESCRIPTION

There is now provided a cemented carbide comprising WC, a binder phase based on Co, Ni or Fe and a submicron gamma phase. The binder phase content is 3 to 15 weight-% (wt-%), preferably 6 to 12 wt-%, and the amount of gamma phase is 3 to 25 volume-% (vol-%), preferably 5 to 15 vol-% with an average grain size of <1 μm, preferably <0.8 μm. The ratio between the WC content in the cubic carbide raw material and the WC solubility in the gamma phase (the factor $f_{WC}$ defined in equation (2)) is 0.6 to 1.0, preferably 0.8 to 1.0. Preferably the average WC grain size is <1 μm, most preferably <0.8 μm.

There is also provided a method of making a cemented carbide comprising WC, a binder phase based on Co, Ni or Fe and gamma phase by powder metallurgical methods. For example, methods can include wet milling powders forming hard constituents and binder phase, drying, pressing and sintering to bodies of desired shape and dimension. In exemplary embodiments, the powders forming gamma phase are added as a cubic mixed carbide, (Me, W)C where Me is one or more of Ti, Ta, Nb, Zr, Hf and V, preferably where Me is one or more of Ti, Ta, and Nb. The cubic mixed carbide is alloyed with an amount of WC given by the mol fraction of WC, $x_{WC}$, such that the ratio between $x_{WC}$ and the equilibrium gamma phase WC content at the sintering temperature expressed as mol fraction WC, $xe_{WC}$, is expressed by the relation:

$$f_{WC}=x_{WC}/xe_{WC} \quad \text{(Eq. 3)}$$

wherein $f_{WC}$ is 0.6 to 1.0, preferably 0.8 to 1.0. Where Me is one or more of Ti, Ta, and Nb, the WC solubility at the sintering temperature, $xe_{WC}$, is given by the relation:

$$xe_{WC}=(0.383*x_{TiC}+0.117*x_{NbC}+0.136*x_{TaC})/(x_{TiC}+x_{NbC}+x_{TaC}).$$

Preferably, the cubic carbides have a submicron grain size. In a preferred embodiment the WC-powder is also submicron.

Cemented carbide bodies can optionally be provided with thin wear resistant coatings as known in the art.

Example 1

Invention

Figure 1:
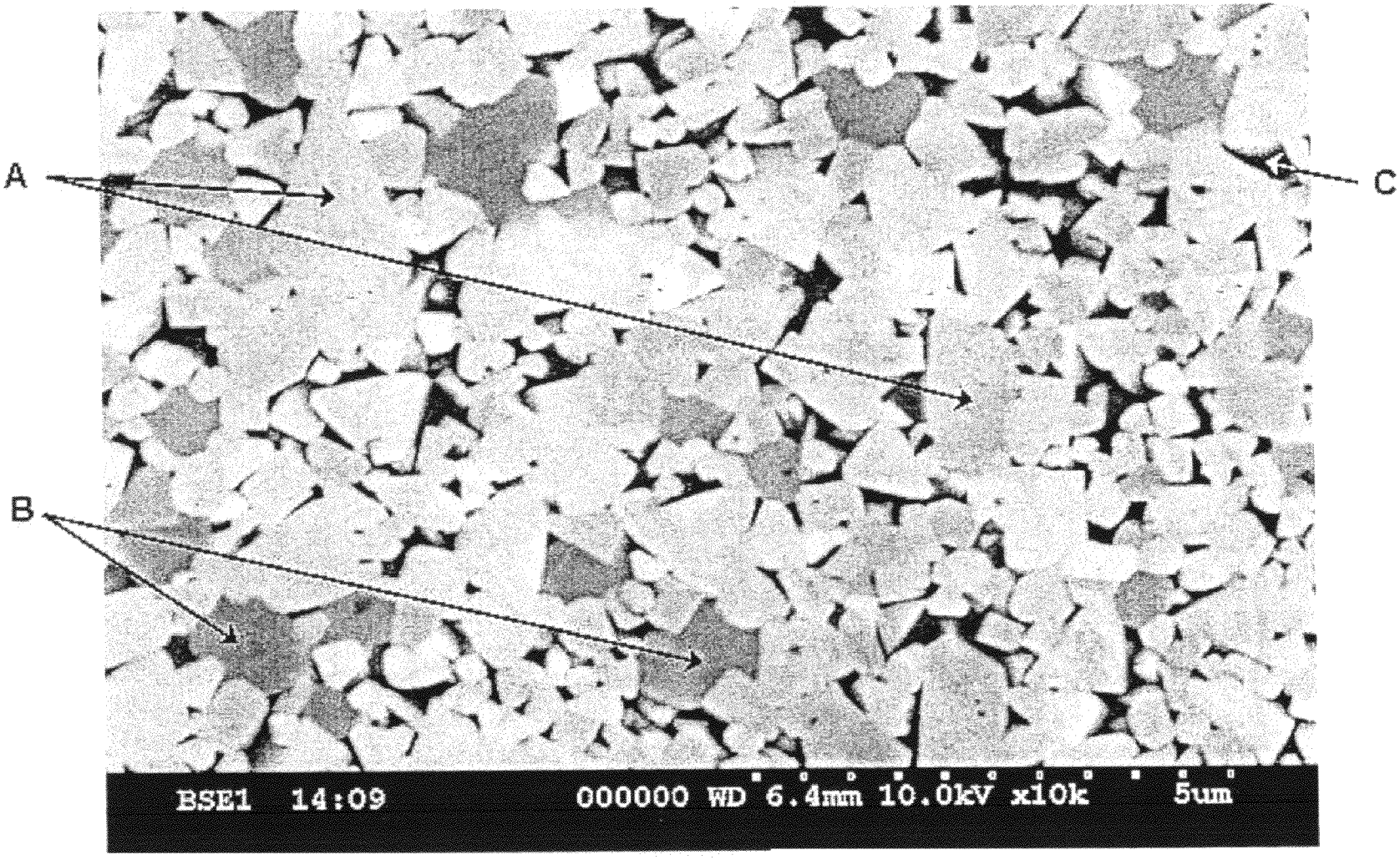
FIG. 1 shows a scanning electron micrograph of the microstructure of a submicron cemented carbide (magnification 10000×) according to the present disclosure.

Cutting tool inserts of type N123G2-0300-0003-TF were made by wet milling of 1.75 kg WC with an FSSS grain size of 0.8 μm, 0.2 kg Co-powder and 0.04 kg of a (Ti, Ta, W)C powder, e.g., a cubic mixed carbide powder, with a composition expressed as mol fraction of $x_{TiC}$=0.585, $x_{TaC}$=0.119 and $x_{WC}$=0.296, corresponding to $f_{WC}$=0.867 and an FSSS grain size of 0.6 μm, drying, pressing and sintering at 1410° C. for 1 h. The microstructure is shown in FIG. 1. It consists of 16 vol-% Co (annotated as C), 77 vol-% submicron WC (annotated as A) and 7 vol-% gamma phase (annotated as B) with a grain size of 0.7 μm.

Example 2

Comparative

Figure 2:
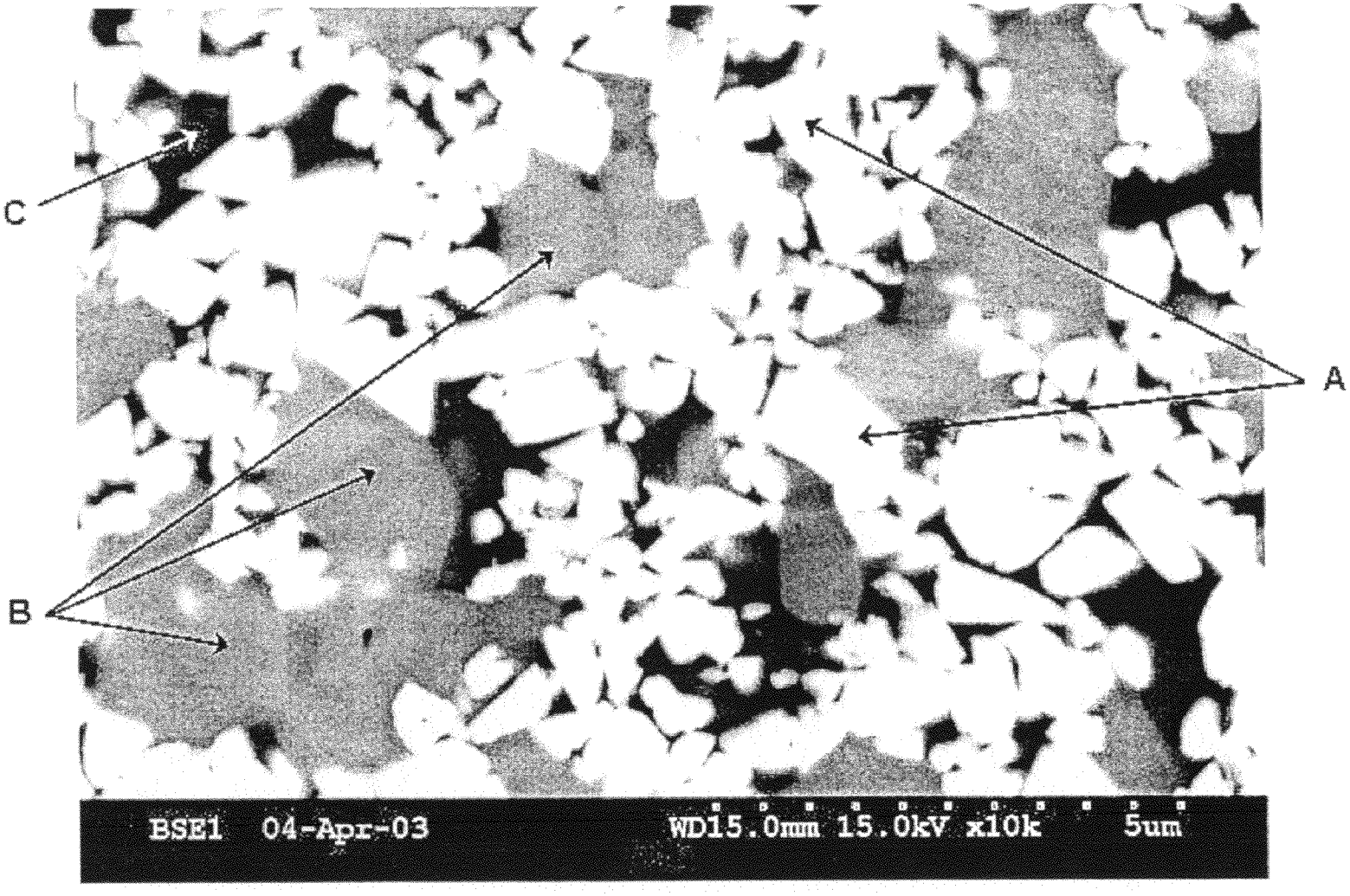
FIG. 2 shows a scanning electron micrograph of the microstructure of a comparative submicron cemented carbide (magnification 10000×).

Example 1 was repeated, but the gamma phase forming elements were added as single carbides, i.e., TiC and TaC to the same composition. The corresponding microstructure is shown in FIG. 2, in which A indicates WC, B indicates gamma phase, and C indicates binder phase. The gamma phase B is present as large areas with a size of about 3 μm.

Example 3

Cutting inserts from examples 1 and 2 were tested in grooving of steel SS2541, Cutting speed VC=200 m/min, feed/rev=0.2 mm and depth of cut 10 mm. As a reference, cutting inserts of Sandvik Coromant grade GC1025 consisting of 0.8 μm WC and 10 wt.-% Co were used. The inserts from example 1 and 2 and the reference inserts were PVD coated in the same batch with (TiAl)N+TiN according to the art.

FIGS. 3*a-c* show the wear pattern of a reference insert and FIGS. 4*a-c* show the wear on an insert made according to the invention. The insert from example 2 broke after 25 passes, the reference insert broke after 52 passes and the insert according to the invention broke after 82 passes.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A method of making a cemented carbide, the cemented carbide including WC and a binder phase based on Co, Ni or Fe, and a gamma phase, the method comprising:

wet milling powders forming hard constituents and binder phase;

drying the wet milled powders; and pressing and sintering the dried milled powders to form a body having a desired shape and a desired dimension, wherein powders forming gamma phase are added as a cubic mixed carbide (Me,W)C alloyed with an amount of WC, the amount of WC given by mol fraction of WC, $x_{WC}$, wherein Me is one or more of Ti, Ta, Nb, Zr, Hf and V, wherein a ratio, $f_{WC}$, between $x_{WC}$ and an equilibrium gamma phase WC content at a sintering temperature expressed as mol fraction WC, $xe_{WC}$, is given by:

$$f_{WC}=x_{WC}/xe_{WC}$$

wherein $f_{WC}$ is 0.6 to ≦1.0.

2. The method of claim 1, wherein $f_{WC}$ is 0.8 to ≦1.0.

3. The method of claim 1, wherein Me is one or more of Ti, Ta and Nb and $xe_{WC}$ is given by:

$$xe_{WC}=(0.383*x_{TiC}+0.117*x_{NbC}+0.136*x_{TaC})/(x_{TiC}+x_{NbC}+x_{TaC}).$$

4. The method according to claim 3, wherein the powders forming gamma phase have a grain size <1 μm.

5. The method according to claim 3, wherein the WC-powder is submicron.

6. The method according to claim 3, comprising coating the formed body with a thin wear resistant coating.

7. The method according to claim 1, wherein the binder phase content is from 3 to 15 wt %.

8. The method according to claim 1, wherein the gamma phase content is from 3 to 25 vol %.

9. The method according to claim 4, wherein the powders forming gamma phase have a grain size <0.8 μm.

10. The method according to claim 5, wherein the WC-powder has a grain size <0.8 μm.

11. The method according to claim 1, wherein Me is two or more of Ti, Ta, Nb, Zr, Hf and V.

* * * * *